US008573318B2

(12) United States Patent
Novero

(10) Patent No.: US 8,573,318 B2
(45) Date of Patent: Nov. 5, 2013

(54) FIRE EXTINGUISHER NOZZLE

(75) Inventor: Guillaume Pierre Novero, Garches (FR)

(73) Assignee: Kidde Technologies, Inc., Wilson, NC (US)

( * ) Notice: Subject to any disclaimer, the term of this patent is extended or adjusted under 35 U.S.C. 154(b) by 632 days.

(21) Appl. No.: 12/722,675

(22) Filed: Mar. 12, 2010

(65) Prior Publication Data

US 2011/0139468 A1 Jun. 16, 2011

(30) Foreign Application Priority Data

Dec. 14, 2009 (FR) ..... 09 58959

(51) Int. Cl.
*A62C 31/02* (2006.01)

(52) U.S. Cl.
USPC ..... 169/74; 169/30; 169/71; 239/288

(58) Field of Classification Search
USPC ..... 169/30, 71, 74; 239/288
See application file for complete search history.

(56) References Cited

U.S. PATENT DOCUMENTS

| | | | | |
|---|---|---|---|---|
| 2,819,764 | A | 1/1958 | Anthony, Jr. | |
| 3,199,934 | A | 8/1965 | Van Wyk | |
| 3,204,698 | A | 9/1965 | Blackman | |
| 3,901,322 | A | 8/1975 | Winston | |
| 4,359,096 | A * | 11/1982 | Berger | 169/44 |
| 4,390,069 | A | 6/1983 | Rose, Jr. | |
| 4,484,710 | A | 11/1984 | Roznieck | |
| 4,531,588 | A | 7/1985 | Brunsicke | |
| 4,815,541 | A | 3/1989 | Arrington | |
| 5,520,331 | A | 5/1996 | Wolfe | |
| 5,857,627 | A | 1/1999 | Horwell et al. | |
| 6,116,049 | A | 9/2000 | Flipczak | |
| 6,223,827 | B1 * | 5/2001 | Zuev et al. | 169/9 |
| 6,886,640 | B1 * | 5/2005 | Dushkin et al. | 169/30 |
| 7,021,559 | B2 | 4/2006 | Fraser-Easton | |
| 7,461,864 | B2 * | 12/2008 | Ervin | 280/781 |
| 2004/0069797 | A1 | 4/2004 | Tien et al. | |

FOREIGN PATENT DOCUMENTS

| | | |
|---|---|---|
| EP | 1707243 | 10/2006 |
| WO | 0067850 | 11/2000 |

OTHER PUBLICATIONS

FR Search Report dated Jun. 18, 2010.
European Search Report dated Jun. 10, 2010.

* cited by examiner

*Primary Examiner* — Dinh Q Nguyen
(74) *Attorney, Agent, or Firm* — Carlson, Gaskey & Olds

(57) ABSTRACT

An extinguisher for minimizing fires includes a container for holding an extinguishing fluid, a propellant disposed within the container for expelling the fluid from the container if desired, and a nozzle for directing the fluid towards a fire. The nozzle has an input for receiving the fluid from the container and an outlet for directing the fluid towards the fire. The nozzle includes an expansion chamber disposed between the input and the outlet of the nozzle. The nozzle outlet has a restrictor for restricting flow of the fluid from the expansion chamber.

12 Claims, 1 Drawing Sheet

FIRE EXTINGUISHER NOZZLE

RELATED APPLICATION

This application claims priority to French Patent Application No. 0958959, which was filed Dec. 14, 2009.

BACKGROUND

Regulations require passenger aircraft to carry a fire extinguisher. Some extinguishers are required to put out an EN34B fire in which the extinguisher must put out 34 liters of flammable liquid, for example heptane, before expiring. In the past, an aircraft might have carried extinguishers that used the various formulations of Halon that were effective but since deemed to be dangerous to the atmosphere.

Newer extinguishers use other fluids as a substitute for Halon. Such fluids are usually discharged as a stream of gas and liquid droplets that penetrate into the fire area and cause the combustion process to end through heat absorption and a chemical interaction.

SUMMARY

According to the invention, an extinguisher for minimizing fires includes a container for holding an extinguishing fluid, a propellant disposed within the container for expelling the fluid from the container if desired, and a nozzle for directing the fluid towards a fire. The nozzle has an input for receiving the fluid from the container and an outlet for directing the fluid towards the fire. The nozzle includes an expansion chamber disposed between the input and the outlet, the outlet having a restrictor for restricting flow of the fluid from the expansion chamber.

According to a further embodiment of the invention, a nozzle for directing an extinguishing fluid towards a fire has an input for receiving the fluid and an outlet for directing the fluid towards the fire. The nozzle also has an expansion chamber disposed between the input and the outlet of the nozzle and a restrictor for restricting flow of the fluid from the expansion chamber.

According to a still further embodiment of the invention, a method for extinguishing a fire includes the steps of; directing an extinguishing fluid to a nozzle having an input for receiving the fluid and an outlet for directing the fluid towards the fire, expanding the fluid between the input and the outlet, and restricting the fluid before expelling it from the outlet.

By adding an expansion chamber in the nozzle, the weight penalty caused by replacing Halon in an extinguisher that puts out an EN34B fire is reduced by almost two thirds.

DETAILED DESCRIPTION

Figure 1:
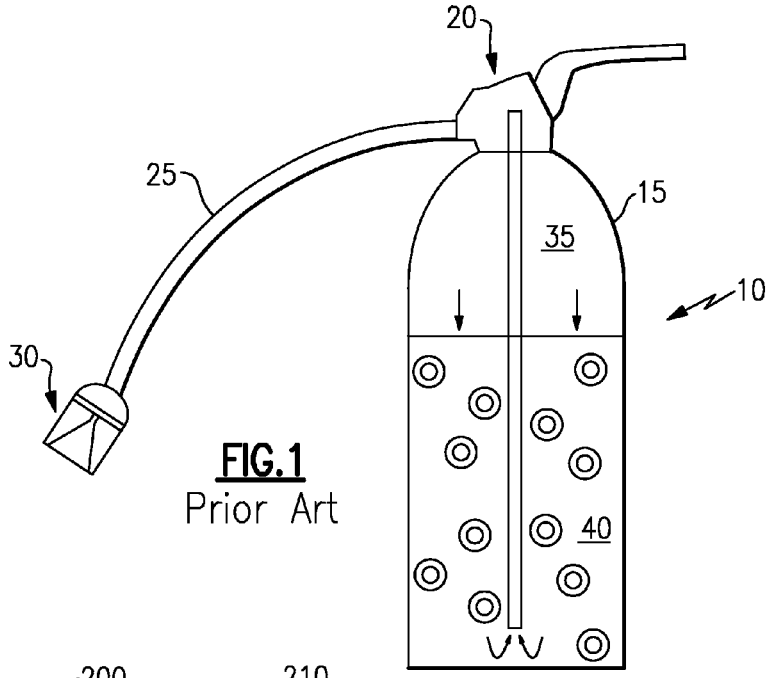
FIG.1 Prior Art
FIG. 1 is a prior art depiction of a typical fire extinguisher.

Referring to FIG. 1, a prior art fire extinguisher 10 is shown. The fire extinguisher has a bottle 15, a valve 20, a hose 25 and a nozzle 30 for directing a suppressant fluid 40 to the fire when the valve 20 is operated. A gas 35, that is usually inert such as nitrogen, pressurizes the bottle and acts to force the fluid 35 out of the bottle 15 if the valve 20 is opened. In this embodiment a fluid such as Dupont™ FE-36™ fire suppressor is shown and about 2 kilograms of FE36™ fire suppressor are required to extinguish an EN34B fire.

Some earlier Halon systems only required 1.13 kilograms of Halon. The additional FE-36™ places a 77% weight penalty on the fire extinguisher relative to the weight of Halon. This additional weight is typically too great for aviation applications in which weight reduction is a constant requirement.

Figure 3:
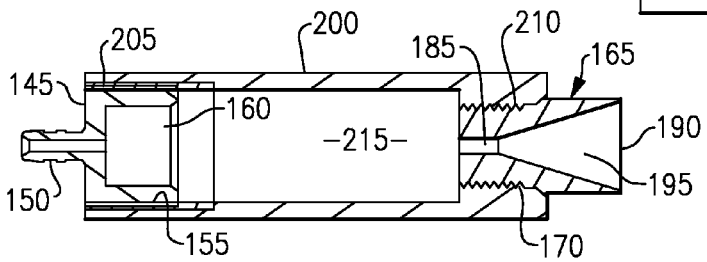
FIG. 3 is an embodiment of the nozzle of FIG. 2.
Figure 2:
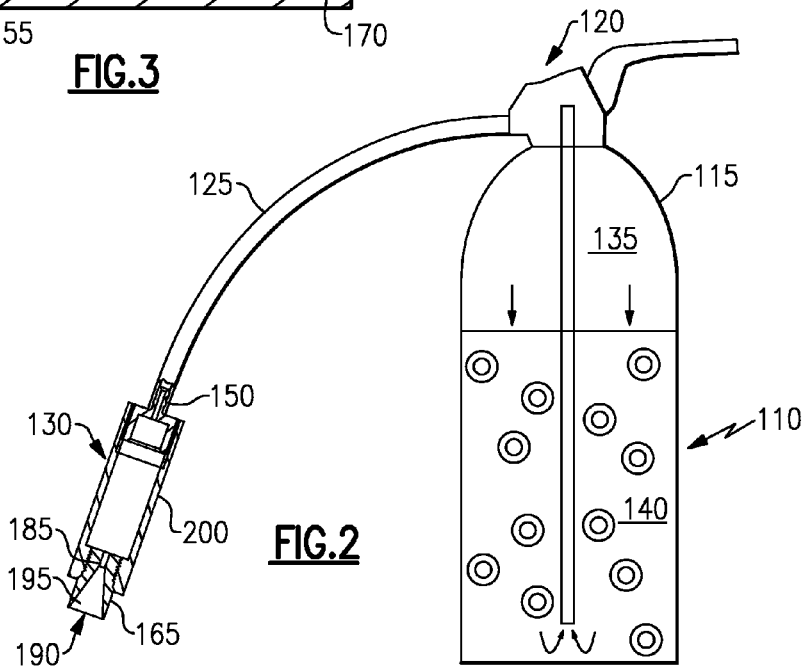
FIG. 2 is a schematic depiction of the fire extinguisher of the invention.

Referring now to FIGS. 2 and 3, an embodiment of the fire extinguisher 110 of the invention is shown. The fire extinguisher 110 is very similar to the prior art fire extinguisher 10 except that the nozzle 130 has an expansion chamber 215 shown therein. The other difference, of course, is that, due to the use of the expansion chamber 215, only 1.4 kilograms of the FE-36™ fire suppressor 140 is required. The weight penalty relative to using Halon is now only 24% compared to the earlier Halon 1211 systems. The 1.4 kilograms of the FE-36™ fire suppressor used with the embodiment of the invention shown herein approaches a minimum required amount of 1.2 kilograms of FE-36™ fire suppressor.

Referring now to FIG. 3, the nozzle 130 has two parts: a base 145 having a hollow ridged post 150 for attaching to a hose 125, an outer threaded surface 155; and an outer part 165 of having an outer threaded surface 170 for mating with the inner threaded surface 160 of the base 145, one bore 185 that is narrow in diameter relative to the expansion chamber 215, an outlet 190 of the nozzle and a cone-shaped portion 195 for discharging the fluid from the fire extinguishing. A sleeve 200 has a first threaded surface 205 for mating with the outer threaded surface 155 of the base 145 and a second threaded surface 210 for mating with the outer threaded surface 170 of the outer portion 165. The outer sleeve creates an extended expansion chamber 215 between the base 145 and the outer part 165 of the nozzle 130.

In operation, the valve 120 is opened to release the fluid 140 and the gas 135 forces the fluid 140 through the hose 125 to the nozzle 130. In the nozzle, the fluid 140 expands partially and then is ejected through the outer part 165 of the nozzle. The partially expanded fluid is now used to put out an EN34B fire. By utilizing the expansion chamber before outputting the fluid through the nozzle, a weight penalty caused by switching fluids away from Halon is greatly reduced from 77% to 24%.

By injecting the fluid 140 into the expansion chamber 215, the fluid is partially transformed into a gas. Turbulence due to the velocity of the fluid input to the expansion chamber 215 in the presence of ambient air tends to produce a gas phase at the outlet 190 of the nozzle 130 and increase the efficiency of the fluid in extinguishing fires. Moreover, fluid 140 in a more gaseous form passing from the nozzle 130 may minimize a possibility that smaller items on fire are not blown out of the fire by a thinner stream and spread the fire as opposed to putting it out before it is suppressed.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. For instance, the sleeve 200 and the outer part 165 of the nozzle 135 may be one piece or the sleeve and the base 145 may be one piece etc. Fluids other than FE-36™ may be used and the expansion chamber may be sized for other fire types and fluids to reduce the weight thereof. Also, the outer part 165 of the nozzle may take other shapes as required for each type fire a fire extinguisher 110 is intended to be used for. The scope of legal protection given to this disclosure can only be determined by studying the following claims.

The invention claimed is:

1. A fire extinguisher comprising a nozzle for directing an extinguishing fluid towards a fire, said nozzle having an input for receiving said fluid, an outlet for directing said fluid towards the fire, and an expansion chamber disposed between said input and said outlet of said nozzle and having a length dimension that is greater than a width dimensions, said nozzle having a restrictor downstream of said expansion chamber for restricting flow of said fluid from said expansion chamber; and said input includes a base having a hollow ridged post that attaches to a hose.

2. The extinguisher of claim 1 further comprising a cone-like outlet disposed downstream of said restrictor.

3. The extinguisher of claim 1, wherein said extinguishing fluid includes a FE-36™ fire suppressor.

4. The extinguisher of claim 1, wherein said extinguishing fluid excludes water.

5. The extinguisher of claim 1, wherein said base includes an outer threaded part.

6. The extinguisher of claim 1, wherein said outlet includes an outer part having an outer threaded surface that mates with an inner threaded surface of said input.

7. The extinguisher of claim 1, wherein said restrictor includes a bore that is narrower in diameter relative to said expansion chamber.

8. The extinguisher of claim 1, wherein said nozzle includes a sleeve having a first threaded surface and a second threaded surface.

9. The extinguisher of claim 8, wherein said input mates with said first threaded surface and said outlet mates with said second threaded surface.

10. The extinguisher of claim 1, wherein said expansion chamber extends between a base and an outer part of said nozzle.

11. A fire extinguisher comprising a nozzle for directing an extinguishing fluid towards a fire, said nozzle having an input for receiving said fluid, an outlet for directing said fluid towards the fire, and an expansion chamber disposed between said input and said outlet of said nozzle and having a length dimension that is greater than a width dimensions, said nozzle having a restrictor downstream of said expansion chamber for restricting flow of said fluid from said expansion chamber; and said outlet includes an outer part having an outer threaded surface that mates with an inner threaded surface of said input.

12. A fire extinguisher comprising a nozzle for directing an extinguishing fluid towards a fire, said nozzle having an input for receiving said fluid, an outlet for directing said fluid towards the fire, and an expansion chamber disposed between said input and said outlet of said nozzle and having a length dimension that is greater than a width dimensions, said nozzle having a restrictor downstream of said expansion chamber for restricting flow of said fluid from said expansion chamber; and said nozzle includes a sleeve having a first threaded surface and a second threaded surface.

* * * * *